US005901784A

United States Patent [19]

Potier

[11] Patent Number: 5,901,784

[45] Date of Patent: May 11, 1999

[54] HEAT EXCHANGER WITH OVAL OR OBLONG TUBES, AND A METHOD OF ASSEMBLY OF SUCH A HEAT EXCHANGER

[75] Inventor: Michel Potier, Rambouillet, France

[73] Assignee: Valeo Thermique Moteur, LeMesnil-Saint Denis, France

[21] Appl. No.: 08/741,975

[22] Filed: Oct. 31, 1996

[30] Foreign Application Priority Data

Nov. 2, 1995 [FR] France ..... 95 12949

[51] Int. Cl.[6] ..... F28F 9/02

[52] U.S. Cl. ..... 165/173; 165/175; 165/153; 138/109; 29/890.044; 29/890.053

[58] Field of Search ..... 165/173, 152, 165/153, 175; 29/890.044, 890.043, 890.052, 890.053; 138/109, DIG. 11

[56] References Cited

U.S. PATENT DOCUMENTS

| | | | |
|---|---|---|---|
| 3,589,440 | 6/1971 | Friedrich | 165/178 |
| 4,360,060 | 11/1982 | Collgon | 165/173 |
| 4,401,157 | 8/1983 | Cadars | 165/173 |
| 4,682,650 | 7/1987 | Potier | 165/173 |
| 5,101,561 | 4/1992 | Fuhrmann et al. | 165/173 X |
| 5,123,482 | 6/1992 | Abraham | 165/173 |
| 5,174,372 | 12/1992 | Potier et al. | 165/173 |
| 5,355,944 | 10/1994 | Potier | 165/173 X |
| 5,456,311 | 10/1995 | Knecht et al. | 165/173 X |
| 5,490,560 | 2/1996 | Helms et al. | 165/173 |
| 5,535,821 | 7/1996 | Potier | 165/173 |
| 5,579,832 | 12/1996 | Le Gauyer | 165/175 X |

FOREIGN PATENT DOCUMENTS

| | | | |
|---|---|---|---|
| 387 678 | 11/1993 | European Pat. Off. . | |
| 589782 | 3/1994 | European Pat. Off. | 165/173 |
| 624772 | 11/1994 | European Pat. Off. | 165/173 |
| 2 474 674 | 3/1986 | France . | |
| 43 11 892 | 10/1994 | Germany . | |

*Primary Examiner*—Ira S. Lazarus
*Assistant Examiner*—Christopher Atkinson
*Attorney, Agent, or Firm*—Morgan & Finnegan, LLP

[57] ABSTRACT

A heat exchanger, especially a heating or cooling radiator for a motor vehicle, has a tube bundle consisting of oval or oblong tubes which extend through a matrix of cooling fins. End portions of the tubes are introduced into holes in a header plate, with a compressible sealing gasket being interposed, the gasket having collar portions surrounding the tube end portions, and the latter having an oval or oblong cross section. The major axis of each tube end is equal to the major axis of the body of the tube, while the minor axis of the tube end is greater than the minor axis of the body of the tube as a result of the tube having been expanded or flared during the assembly of the heat exchanger.

13 Claims, 3 Drawing Sheets

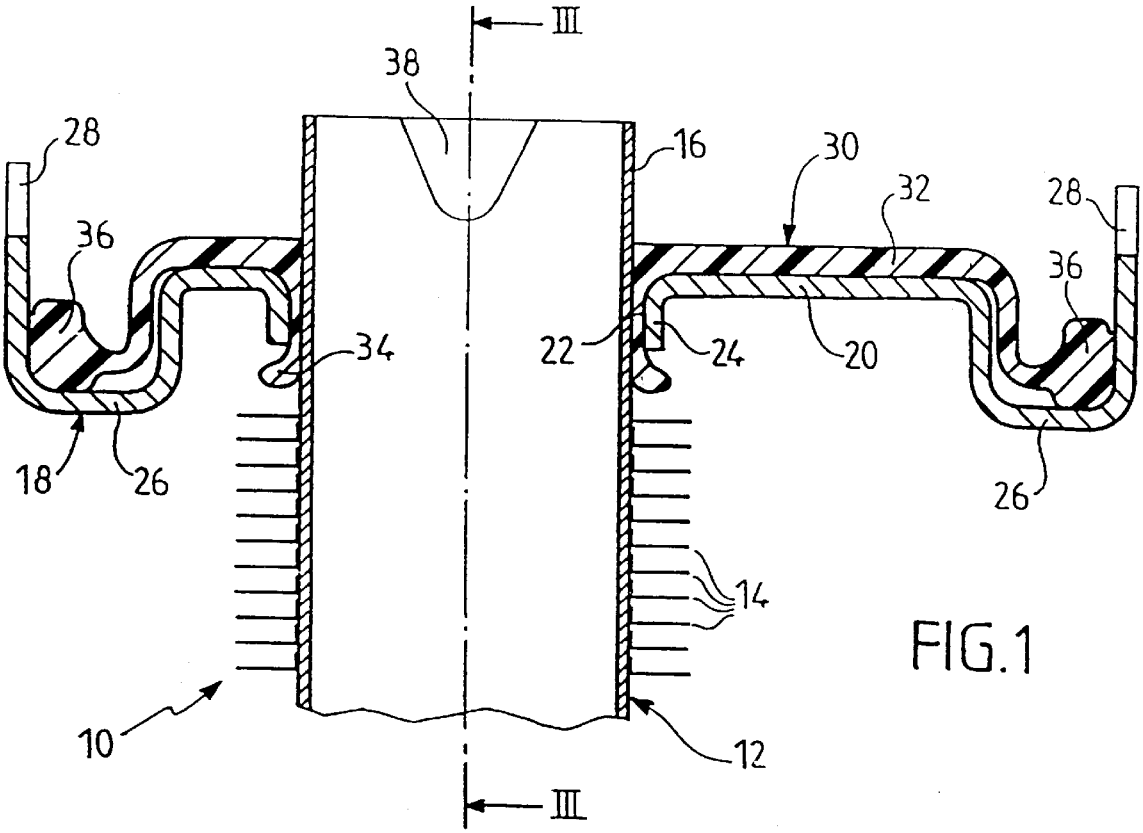
FIG.1
FIG. 2
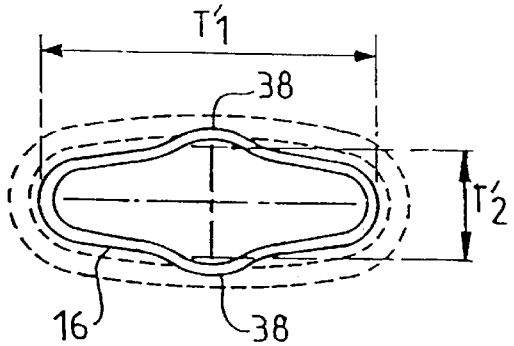
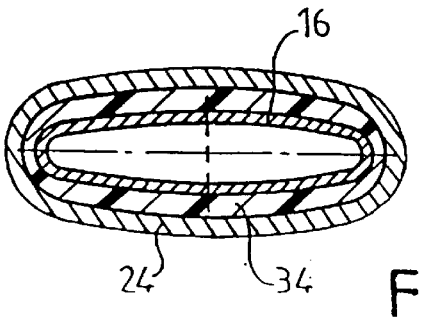
FIG.9
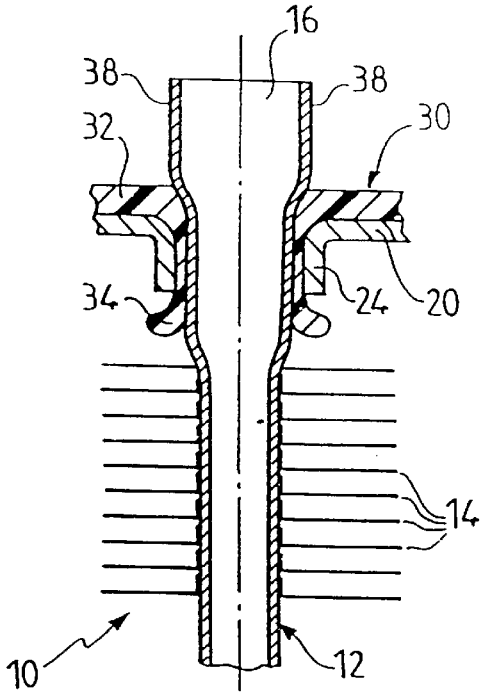
FIG.3

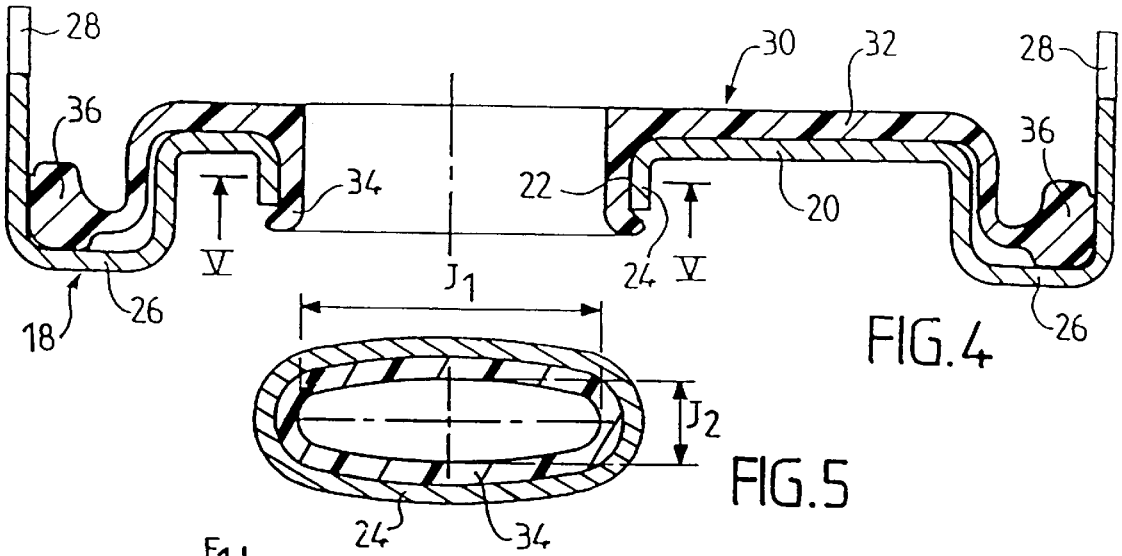
FIG.4
FIG.5
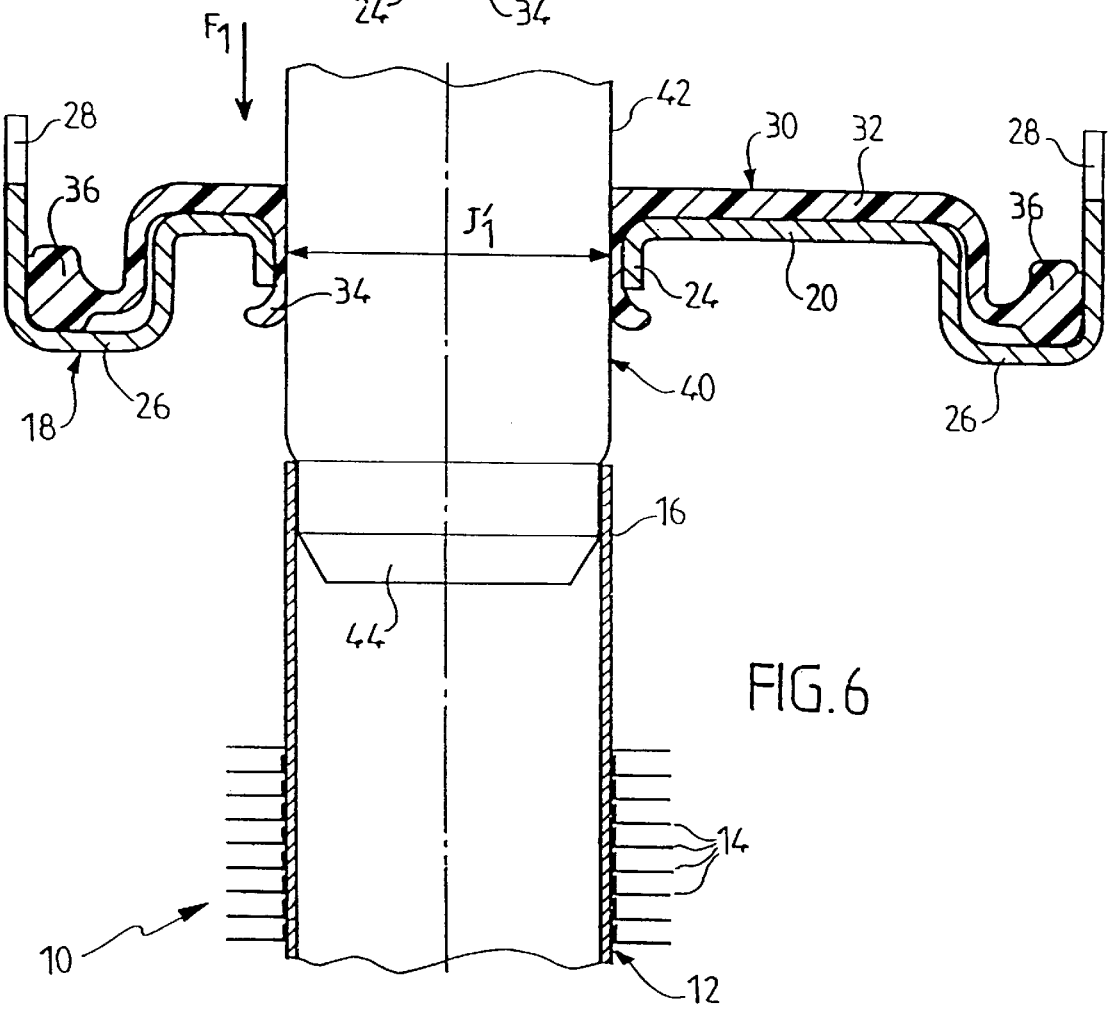
FIG.6
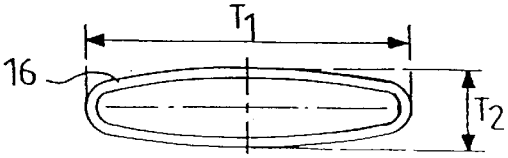
FIG.7

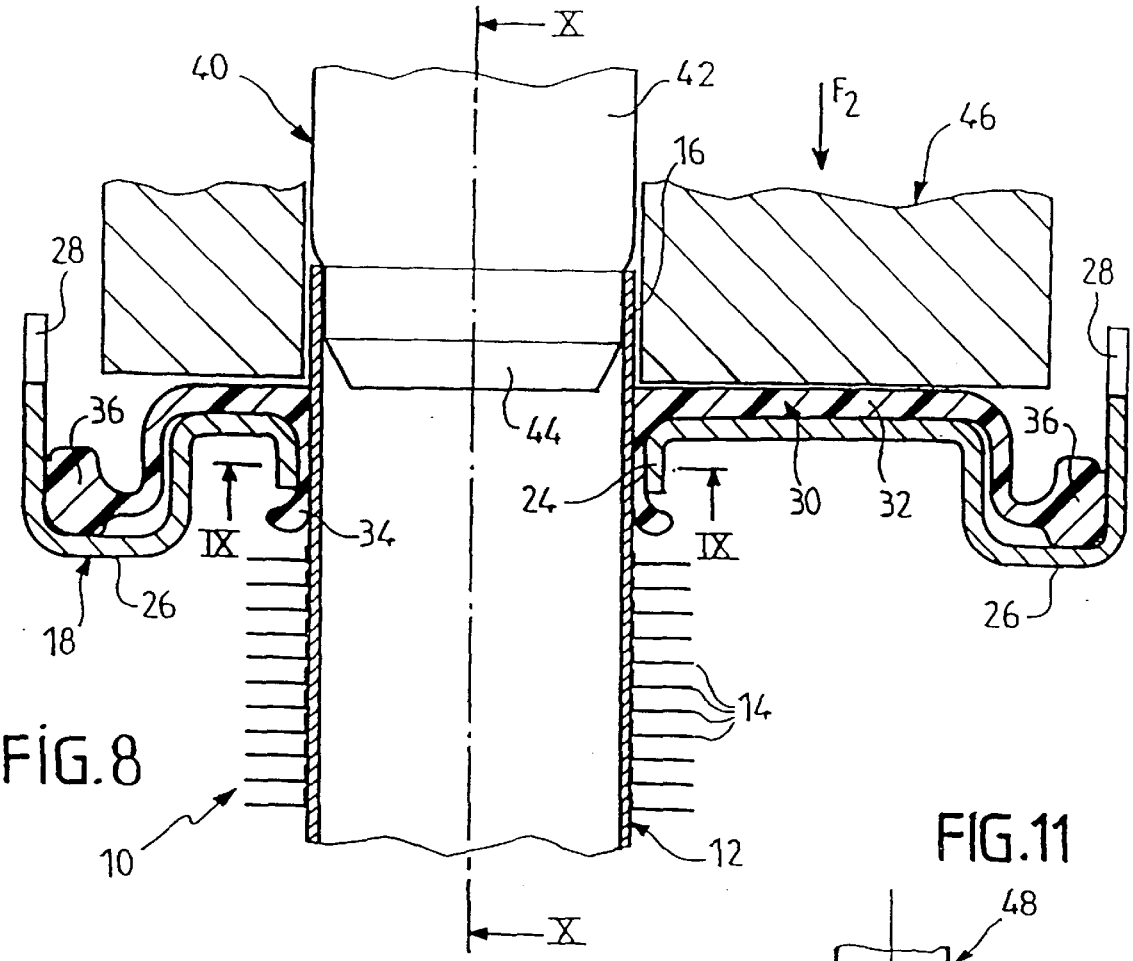
FIG.8
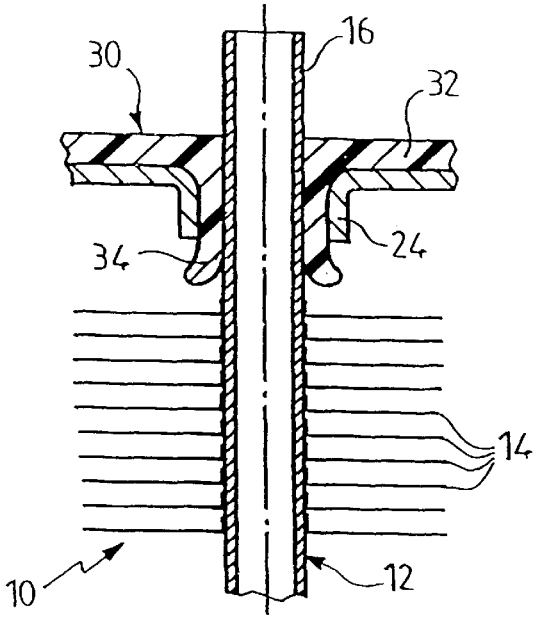
FIG.10
FIG.11
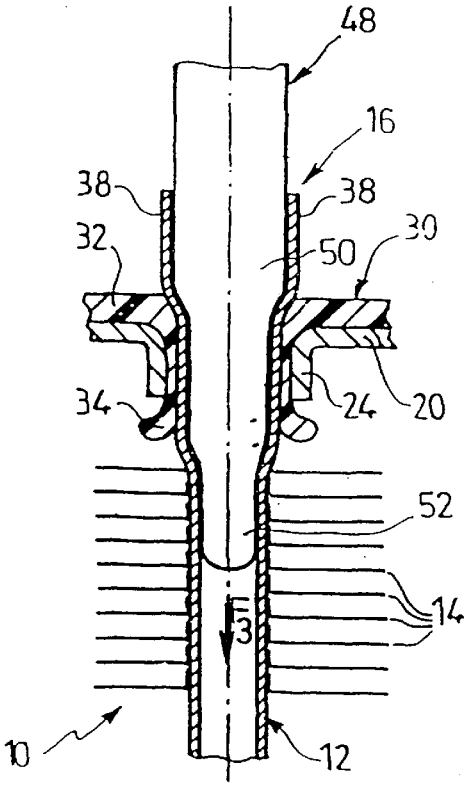

HEAT EXCHANGER WITH OVAL OR OBLONG TUBES, AND A METHOD OF ASSEMBLY OF SUCH A HEAT EXCHANGER

FIELD OF THE INVENTION

This invention relates to heat exchangers, in particular (though not exclusively) for motor vehicles, and to methods of assembling such heat exchangers. More particularly, the invention relates to a heat exchanger of the type comprising a multiplicity of tubes extending through a matrix of fins so as to form a bundle with the latter, the tubes having end portions which are introduced into holes formed in a header plate, with a compressible sealing gasket being interposed, the sealing gasket having collar portions, each of which surrounds the said end portion of a corresponding said tube, the end portion of each tube having an oval or oblong cross section defining a major axis and a minor axis.

BACKGROUND OF THE INVENTION

Such heat exchangers may also be referred to as fitted, or mechanically assembled, heat exchangers, because the tube end portions are subsequently expanded, or flared, so as to compress the collar portions of the gasket. This ensures proper sealing of the connection between the tubes and the header plate, without any need for brazing or similar techniques.

It is known to provide heat exchangers of this type in which the end portions of the tubes are deformed prior to being assembled to the header plate, the deformation being such as to give each tube end portion a different cross section from that of the main body of the tube. In one known way of carrying out this deformation, the cross section of each tube end portion is of rounded form, in the manner disclosed in French patent specification No. FR 2 474 674A. In another known method, the cross section of each tube end portion is deformed to an oval shape in the manner described in European patent specification No. 0 387 678. However, this modification of each tube, in its end portion, has the disadvantage that the cold working of the metal of the tube in this way can sometimes lead to fracture of the wall of the tube during the subsequent expansion or flaring operation which secures the tube to the header plate, and so enables the heat exchanger to be assembled mechanically.

In addition, the change of cross section of the tube between the main body of the tube, i.e. the working part of the tube which is surrounded by the fins of the tube bundle, and the tube end portion itself, entails a portion of the tube being unable to have any fins; or, failing that, it means that any fins associated with that tube portion are necessarily deformed and are therefore relatively ineffective.

DISCUSSION OF THE INVENTION

A main object of the invention is to overcome the above mentioned drawbacks.

According to the invention in a first aspect, a heat exchanger of the type comprising a multiplicity of tubes extending through fins and having end portions introduced into holes in a header plate, with a compressible sealing gasket being interposed, the said sealing gasket having collar portions surrounding the end portions of the tubes, and in which at least the end portion of each tube has an oval or oblong cross section defining a major axis and a minor axis, is characterised in that the major axis of the end portion of the tube is equal to the major axis of the main body of the tube, while the minor axis of the end portion of the tube is greater than the minor axis of the main portion of the tube as a result of the tube being expanded during the assembly of the heat exchanger.

Thus, the tube end portion is not formed to shape prior to assembly, that is to say before the tube is fitted to the header plate. As a result, during introduction of the end portions of the tubes into the holes in the header plate, the tube end portions have the same cross section as the holes in the header plate. Due to the fact that the tube is not formed to shape prior to being fitted to the header plate, only a very small part of the length of the tube need be left without any fins. This increases the useful surface area of the tube bundle for heat transfer purposes.

Mechanical assembly, i.e. the fitted form of construction of the heat exchanger, is achieved only by expansion of the tube in the direction of the minor axis, this expansion being carried out on those portions of the wall of the end portion of the tube that are of large radius. This avoids the cold working problems which would otherwise be produced in methods of the prior art as mentioned above. As a result of this, the deformation of the end portion of the tube resulting from the expansion, or flaring, operation is carried out in a very limited zone. This avoids the faults commonly met with, and in addition it enables alloys with better mechanical properties to be used.

According to a preferred feature of the invention, the cross section of the end portion of the tube, prior to assembly, is the same as the cross section of the main body of the tube. In other words, the whole of the tube is of uniform cross section prior to assembly, its end portion not being reformed until after assembly.

Preferably, the compression of each collar portion of the sealing gasket in the direction of the major axis is carried out before the end portion of the corresponding tube is introduced into it, while the compression of the collar portion of the sealing gasket in the direction of the minor axis results from the subsequent operation of expanding the tube during the assembly of the heat exchanger.

According to another preferred feature of the invention, the major axis of the tube is greater than the internal major axis of the collar portion of the gasket prior to compression of the latter, while the minor axis of the tube is smaller than the internal minor axis of the collar portion of the gasket before the latter is compressed.

According to the invention in a second aspect, a method of assembly of a heat exchanger in accordance with the said first aspect of the invention is characterised in that it essentially comprises the following operations:

(a) providing a multiplicity of tubes extending through a set of fins, with each tube having an oval or elongated cross section defining a major axis and a minor axis, together with a free end portion of the tube;

(b) providing a header plate formed with holes of oval or elongated cross section and equipped with a compressible sealing gasket defining collar portions of the gasket which are adapted to be engaged respectively through the said holes;

(c) compressing each collar portion of the gasket in the direction of its major axis;

(d) introducing the respective end portions of the tubes into the holes in the header plate and into the collar portions of the sealing gasket, the said collar portions being held in a compressed condition in the direction of the major axis; and (e) subjecting the end portions of the tubes to expansion in the direction of their minor axis, so as to compress the gasket collar portions in that direction.

In accordance with a preferred feature of the method according to the invention, in operation (a), i.e. prior to assembly, the cross section of the end portion of each tube is identical to the cross section of the main body of the tube.

Operation (c), in which each collar portion of the gasket is compressed in the direction of a major axis, is preferably carried out by means of a punch having a free end portion which is adapted to be introduced into the end portion of the corresponding tube without deforming the latter.

In accordance with yet another preferred feature of the invention, operation (d), in which the end portions of the tubes are introduced, is effected by displacing the header plate by means of a press tool.

According to a further preferred feature of the invention, operation (e), in which the tube end portion is expanded or flared, is carried out by means of a further punch which enlarges the end portion of the tube in the direction of the minor axis.

Further aspects, features and advantages of the invention will appear more clearly on a reading of the following detailed description of a preferred embodiment of the invention, which is given by way of non-limiting example only and with reference to the accompanying drawings.

BRIEF DESCRIPTION OF THE DRAWINGS

FIG. 1 is a view in transverse cross section showing a small portion of a heat exchanger in accordance with the invention, fully assembled.

FIG. 2 is an end-on view of the end portion of one tube of the heat exchanger shown in FIG. 1.

FIG. 3 is a view in cross section taken on the line III—III in FIG. 1.

FIG. 4 is a view in transverse cross section of the header plate and the sealing gasket in the heat exchanger of FIG. 1, prior to assembly.

FIG. 5 is a view in cross section taken on the line V—V in FIG. 4.

FIG. 6 is a view similar to that in FIG. 4, and illustrates one step in the method of assembly of the heat exchanger, in which a punch is introduced through each hole in the header plate and inserted into a tube of the bundle.

FIG. 7 is an end view on a tube before assembly.

FIG. 8 is a view in cross section similar to that in FIG. 6, and illustrates a subsequent step in the method of assembly, in which the ends of the tubes have been introduced into the holes in the header plate.

FIG. 9 is a view in cross section taken on the line IX—IX in FIG. 8.

FIG. 10 is a view in cross section taken on the line X—X in FIG. 8.

FIG. 11 is a view in cross section similar to that in FIG. 10, showing the method of expanding the end portion of the tube.

DESCRIPTION OF A PREFERRED EMBODIMENT OF THE INVENTION

The heat exchanger shown in FIGS. 1 and 3 comprises a bundle 10 which includes a multiplicity of tubes 12 of oval cross section. These tubes are arranged parallel to each other in a single row. The tubes 12 extend through a large number of fins 14, which consist of substantially rectangular thin metal plates arranged parallel to each other and at right angles to the tubes in the bundle, the bundle consisting of the tubes and fins.

Each tube 12 has a free end portion 16 which is assembled mechanically, i.e. by being dry fitted, to a header plate 18 (also preferred to as a collector). Prior to assembly of the tubes and the header plate together, the end portion 16 of each tube 12 has exactly the same cross section as the remainder of the tube, i.e. the main body of the tube around which the fins 14 are arranged.

The header plate 18 includes a spine portion 20 of generally rectangular form, which has a multiplicity of through holes 22 of oval cross section, in which the end portions 16 of the tubes are received. Each hole 22 is surrounded by a collar portion 24, which projects from the spine portion 20 on the side of the latter facing towards the fins 14. The spine portion 20 is extended by a peripheral channel portion 26 which defines an outwardly facing groove, and which is terminated by a peripheral flange 28 which is formed with lugs capable of being bent back.

The header plate 18 receives a compressible sealing gasket 30 which includes a spine portion 32, the latter being overlaid on the spine portion 20 of the header plate. The gasket spine portion 32 is joined to a multiplicity of gasket collar portions 34, each of which is introduced into a respective one of the holes 22 in the header plate, so as to provide sealing between the end portion 16 of the corresponding tube 12 and the corresponding collar portion 24 of the header plate. In addition, the gasket spine portion 32 is formed with a peripheral bead 36 which lies in the groove formed by the channel portion 26, and which provides sealing between the header plate and a header cover (not shown) when the peripheral flange 28 is bent back appropriately. The header cover and the header plate together constitute a header of the heat exchanger.

Reference is now made to FIG. 2, in which it can be seen that, in the fully assembled state, the cross section of the end portion 16 of the tube has a substantially oval form, which is characterised by a major axis T'1 and a minor axis T'2. The major axis T'1 is equal in length to the major axis T1 (see FIG. 7) of the cross section of the end portion 16 of the tube prior to assembly, this cross section being identical to that of the main body of the tube.

By contrast, the length of the minor axis T'2 in the fully assembled state is greater than that of the corresponding minor axis T2 before assembly (see FIG. 7), because the end portion 16 has undergone a first operation of radial expansion. A local, second radial expansion operation augments this first expansion, to form two bulges 38, as can be seen in FIGS. 1, 2 and 3. These bulges prevent any displacement of the tube with respect to the header plate.

The assembly of the heat exchanger of FIGS. 1 and 3 will now be described with reference to FIGS. 4 to 11. FIG. 4 shows the header plate 18 and its sealing gasket 30 prior to assembly. In this state, each collar portion 34 of the gasket 30 is in an uncompressed state. It has an internal major axis J1 (see FIG. 5) which is smaller than the major axis T1 of the end portion 16 of the corresponding tube (FIG. 7). The collar portion 34 also has a minor axis J2 (see FIG. 5), which is greater than the minor axis T2 of the tube end portion 16 in FIG. 7.

As is shown in FIG. 6, the header plate 18, equipped with its gasket 30, is placed close to the tube bundle 10, in such a way that the holes 22 are in line with the end portions 16 of the tubes. A set of punches 40 is then introduced in the direction of the arrow F1. Each of these punches 40 has a body 42 with an oval cross section, having an end portion 44 which is so configured as to be easily introduced into an end portion 16 of a tube 12 without deforming the latter.

Each punch 42 is so designed as to exert a compressive force on the interior of the corresponding gasket collar portion 34, but only in the direction of its major axis, so as to change the dimension of this major axis from the value J1 in FIG. 5 to a value J'1 (see FIG. 6), which corresponds to the value T1 of the major axis of the tube in order to facilitate introduction of the tube. This is therefore a method of assembly with pre-stressing of the gasket. However, this pre-stressing of the gasket occurs only in the direction of its major axis. In this connection, it is not necessary to exert any pre-stress in the direction of the minor axis, because the minor axis J2 of the compressible collar portion (FIG. 5) is greater than, or equal to, the minor axis T2 of the end portion 16 of the tube.

It will be understood that, in the condition shown in FIG. 6, the gasket collar portion 34 has been subjected to a compressive force in the direction of its major axis, but not in the direction of its minor axis; this facilitates the subsequent introduction of the end portion 16 of the corresponding tube. As shown in FIG. 8 to which reference is now made, a press tool 46 is used for this purpose. The press tool 46 is displaced in the direction of the arrow F2, and bears on the spine portion 32 of the compressible gasket 30. The displacement of the press tool 46 causes the whole assembly consisting of the header plate 18 and the compressible gasket 30 to be itself displaced, so that each tube end portion 16 is thereby introduced into a corresponding collar portion 34, which has been precompressed in the direction of its major axis.

As can be seen in FIG. 8, 9 and 10, the end portion 16 of the tube now extends through the compressible gasket 30. At this stage, each of the gasket collar portions 34 is compressed in the direction of its major axis, but not in the direction of its minor axis.

The expansion of each of the tube end portions 16 is subsequently carried out. With reference to FIG. 11, this is done by means of a set of further punches 48, which are displaced in the direction of the arrow F3 in FIG. 11. Each punch 48 has a body portion 50 which is terminated by an end portion 52. The end portion 52 of each punch is introduced into the end portion 16 of the corresponding tube, so as to deform the latter essentially in the direction of its minor axis, thereby forming the two bulges 38 seen in FIGS. 1 to 3. This expansion causes a compressive force to be exerted on the gasket collar portion 34 in the direction of its minor axis. It is then merely necessary to remove the punches 48 (in a direction opposite to that indicated by the arrow F3) to give a heat exchanger such as is shown in FIGS. 1 and 3.

It will be understood that the end portion 16 of each tube 12 is reformed, i.e. deformed to shape, only after assembly, and that the resulting configuration is obtained by means only of an expansion operation in the direction of the minor axis. As a result, this expansion bears on those surfaces of the cross section of the tube that have a large radius, and this eliminates the cold working problems mentioned earlier herein.

The invention is most particularly applicable in the manufacture of heat exchangers for motor vehicles, in particular cooling or heating radiators.

What is claimed is:

1. A heat exchanger comprising a tube bundle and a header, the tube bundle having a multiplicity of tubes and at least one set of fins fitted to the tubes, the header having a header plate formed with a plurality of holes, and a compressible sealing gasket each tube having a tube body and a sealing portion of the tube body and extending through a corresponding one of the holes among the plurality of holes, a collar portion of the sealing gasket interposed between each tube sealing portion and a corresponding one of the holes among the plurality of holes, each tube sealing portion having a cross section defined by a first major axis and a first minor axis, and each tube body having a cross section defined by a second major axis and a second minor axis, wherein the first and second major axes are of equal lengths, each tube sealing portion having an expanded portion, the length of the first minor axis being greater than that of the second minor axis.

2. A heat exchanger according to claim 1, wherein the the sealing portion of each tube is formed from tube stock having a cross section equal to the cross section of the body of said tube.

3. A heat exchanger according to claim 1, wherein each said gasket collar portion defines a third major axis and a third minor axis, the gasket collar portion being in compression in the direction of the third major axis, and being further compressed in the direction of the third minor axis as a result of the expansion of the tube during assembly of the heat exchanger.

4. A heat exchanger according to claim 1, wherein the length of the second major axis is greater than the internal length of the third major axis prior to compression of the gasket collar portion, the length of the second minor axis being smaller than that of the internal third minor axis prior to compression of the gasket collar portion.

5. A coolant tube for a heat exchanger, comprising:

a body region having a cross-section having a major dimension and a minor dimension, said minor dimension being the largest dimension of said body region cross-section perpendicular to said major dimension; and a sealing region for sealing to a header plate, a minor dimension of a cross-section in said sealing region being greater than said body region minor dimension, and a major dimension of said sealing region cross-section being substantially equal to the body region major dimension.

6. The coolant tube of claim 5, further comprising:

a compressible gasket sealing said sealing region into said header plate hole, said gasket being compressed between said sealing region and said header plate.

7. The coolant tube of claim 6, wherein:

the gasket compression is the result of deformation of said sealing region during assembly of the heat exchanger, said deformation being in the direction of said sealing region minor dimension.

8. The coolant tube of claim 5, wherein:

said body region cross-section is substantially elliptical.

9. The coolant tube of claim 5, wherein:

said sealing region cross-section is substantially elliptical.

10. The coolant tube of claim 9, wherein:

said sealing region cross-section has bulges to reduce displacement of the tube relative to said header plate.

11. The coolant tube of claim 5, wherein:

the tube further comprises a flare region between said sealing region and the end of the tube, said flare region having a cross-section larger than said sealing region cross-section.

12. The coolant tube of claim 11, wherein:

a major dimension of the flare region is essentially equal to said sealing region major dimension, and a minor dimension of said flare region is larger than said sealing region minor dimension.

13. The coolant tube of claim 11, further comprising:

a plurality of heat-exchange fins thermally coupled to said body region.

* * * * *